United States Patent [19]

Shew

[11] Patent Number: 4,756,230

[45] Date of Patent: Jul. 12, 1988

[54] SOUND ATTENUATOR FOR PNEUMATIC MOTORS

[75] Inventor: Jerry D. Shew, Niles, Ill.

[73] Assignee: Stewart Warner Corporation, Chicago, Ill.

[21] Appl. No.: 943,734

[22] Filed: Dec. 19, 1986

[51] Int. Cl.[4] ..... F01N 1/08

[52] U.S. Cl. ..... 91/55; 91/291; 181/211; 181/230

[58] Field of Search ..... 60/324; 91/55, 291, 91/471; 137/560; 181/211, 230

[56] References Cited

U.S. PATENT DOCUMENTS 2,166,218 7/1939 Morrison ..... 91/55 X 4,113,052 9/1978 McElroy ..... 181/230

*Primary Examiner*—Robert G. Nilson

*Attorney, Agent, or Firm*—Lorusso & Loud

[57] ABSTRACT

A reciprocating piston and cylinder pneumatic motor with a sound-reducing system that diffuses exhausting air by directing it across the curved outer surface of the cylinder.

9 Claims, 6 Drawing Sheets

SOUND ATTENUATOR FOR PNEUMATIC MOTORS

BACKGROUND OF THE PRESENT INVENTION

Reciprocating piston and cylinder air motors have been in use for well over the past 100 years to drive material handling pumps, power tools and many other uses as a prime mover. These piston and cylinder motors are single acting or double acting. In single acting piston and cylinder devices fluid under pressure is ported selectively to only one side of the piston in a forward stroke, and the piston is returned by non-fluid pressure means, such as a return spring.

In double acting piston and cylinder motors, fluid under pressure is ported into one side of the piston to drive it in a forward stroke and alternately to the opposite side of the piston to drive it in a return stroke. Usually a main directional valve is provided for porting fluid under pressure from a source alternately to two main passages connected to the opposite ends of the piston and for porting fluid from the unpressurized main passage to exhaust.

Noise attenuation has always been a problem with high pressure reciprocating piston air motors because exhaust air blasting from the motor can create a deafening roar that is objectionable and sometimes harmful to workers in the area. For example, sound levels in excess of 90 dBA (sound pressure level measured in A-scale decibels) for a period of eight hours or more is generally considered excessive and, therefore, in need of attenuation. Noise can be attenuated by the use of sound-absorbing materials in the work place, barriers between the sound generator and working personnel, or a muffler at the source. Mufflers have been the most popular technique for reducing noise levels to acceptable values, and for the most part, these include canister-type devices mounted externally to the piston and cylinder air motor that receive exhausting air and decrease the velocity and expand the air before final exhaust from the muffler into the work area. These mufflers achieve velocity deceleration and expansion in a variety of manners, including expansion chambers and flow-stream direction changes with baffling deflectors, and filtering material.

The problem with these mufflers is that because most of them require expansion chambers, they are quite large, and in some cases almost as large as the air motor itself. Frequently these mufflers use filtering techniques that also require periodic cleaning. The size of the muffler and the complexity of the filtering or baffling system make it, unfortunately, a major contributor to the cost of piston and cylinder air motors.

It is a primary object of the present invention to ameliorate the above-noted problems in reciprocating piston pneumatic motor sound attenuation systems.

SUMMARY OF THE PRESENT INVENTION

In accordance with the present invention, a sound attenuation system is provided for reciprocating piston and cylinder air motors that eliminates the necessity for an external muffler.

Toward this end the present reciprocating piston and cylinder air motor includes a valve assembly with a cover that provides a preliminary expansion chamber for exhausting air and a plurality of ports that direct the pre-expanded exhausting air tangentially from the valve assembly in a circumferential direction both clockwise and counterclockwise about the cylindrical outer surface of the cylinder itself.

A portion of the exhaust flow stream from these ports flows in laminar flow across the outer surface of the cylinder with a wall attachment effect. This wall attachment effect was recognized by Henri Coanda over one-half a century ago when he observed that a free jet emerging from a nozzle will tend to follow a nearby curved or inclined surface and will "attach" itself to or come in contact with and flow along the surface if the curvature or angle of inclination is not too sharp. This attachment tendency lies in the fact that the jet stream entrains or picks up nearby fluid molecules. When the supply of these molecules is limited by an adjacent surface, a partial vacuum develops between the jet and the surface, and if the pressure on the other side of the jet remains constant, the partial vacuum which is a lower pressure region will force the jet to bend and attach itself to the wall.

This principle is used in accordance with the present invention to diffuse or "fan" the exhaust stream exiting from the ports. That is, a portion of the air exiting the ports when viewed in the plane transverse to the cylinder, follows the curvature of the cylinder itself because of the Coanda effect. A second portion of the stream is unable to follow the exact curvature of the cylinder but nevertheless flows in an arc on a radius greater than the radius of the cylinder, and the remaining portion of the stream exits in a linear tangential direction. The result of this is that the exiting streams fan out in opposite directions in a plane transverse to the axis of the cylinder thereby diffusing the exhaust streams and attenuating noise.

Because the cylinder outer surface extends 360 degrees and because exhaust flow wraps around the cylinder in both clockwise and counter-clockwise directions, a separation point is found and established where the wall attachment effect can no longer hold the inner flow stream to the wall, and this produces a large eddy adjacent the bottom of the cylinder that further diffuses exhaust flow and adds to noise attenuation.

It can be readily seen that the present invention achieves significant noise attenuaton without any external muffler thereby eliminating the cost and space consumption of prior known muffler assemblies for pneumatic motors.

DETAILED DESCRIPTION OF THE PREFERRED EMBODIMENT

Figure 1:
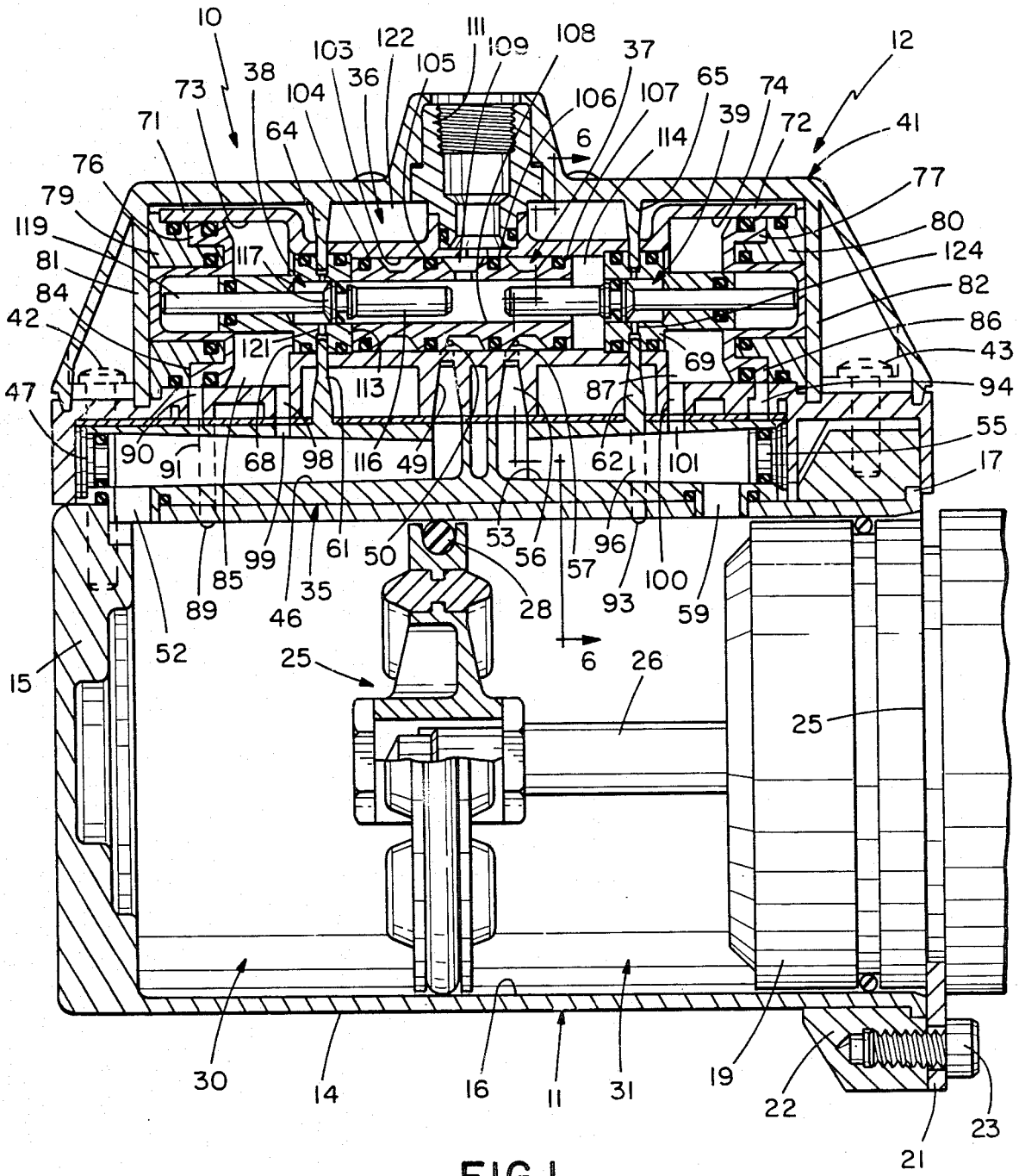
FIG. 1 is a longitudinal section of the present pneumatic motor.

Referring to the drawings and particularly FIGS. 1 to 4, an air motor assembly 10 is illustrated consisting generally of a piston and cylinder assembly 11 and a control valve assembly 12. While the air motor 10 is a general utility reciprocating piston and cylinder air motor, one particular application is to drive a material handling reciprocating piston pump.

Viewing the longitudinal section of FIG. 1, the piston and cylinder assembly 11 includes a cylinder 14 with an integral closed end wall 15, and a cylinder bore 16 with a peripheral flange 17 at its open end. A piston guide 19 is fixed in the open end of cylinder 14 by a face plate 21 connected to a retaining ring 22 by plurality of fasteners 23. Face plate 21 extends into groove 25 in the guide 19 for axially locating the guide within the cylinder 11.

A piston assembly 25 is reciprocably mounted in the cylinder bore 16 and has a rod 26 fixed thereto that is slidably mounted in a through-bore in guide 19 for the purpose of aligning rod 26 and piston 25 for linear reciprocation within the cylinder 11.

Piston 25 has an annular elastomeric seal ring 28 that sealing engages the cylinder bore 16 to divide the cylinder 11 into distinct pressure chambers 30 and 31.

The control valve assembly 12 includes a manifold 35 mounted on the top side of cylinder 11, a valve housing or body 36 mounted on top of the manifold 35 and over retaining ring 22, reciprocably receiving spool valve 37, pilot valves 38 and 39, and a cover 41 that encloses the valve housing or body 36.

Fasteners 42 and 43 clamp the valve body 36 against the manifold 35 and the manifold against the cylinder 11, and fasteners 42 threadedly engage the cylinder end plate 15 on the left side as viewed in FIG. 1, and fasteners 43 engage retaining ring 22 on the right side 22.

Figure 2:
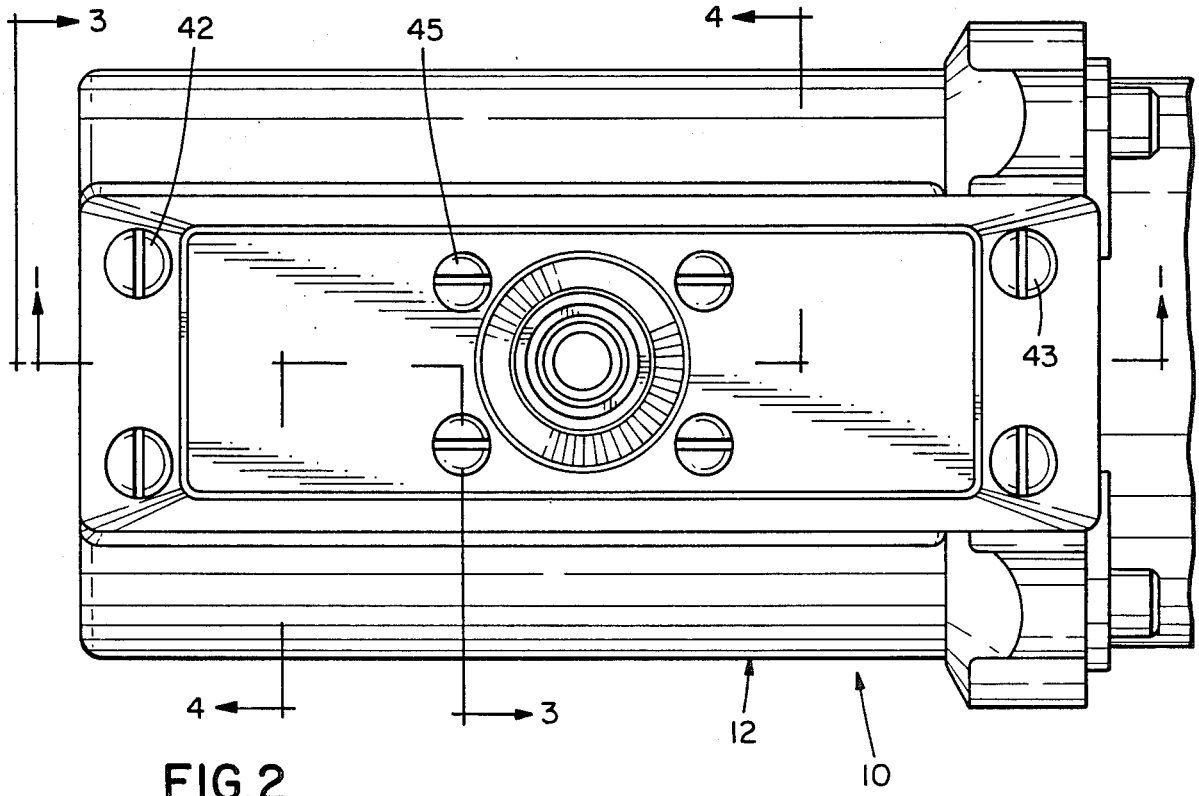
FIG. 2 is a top view of the pneumatic motor illustrated in FIG. 1.
Figure 3:
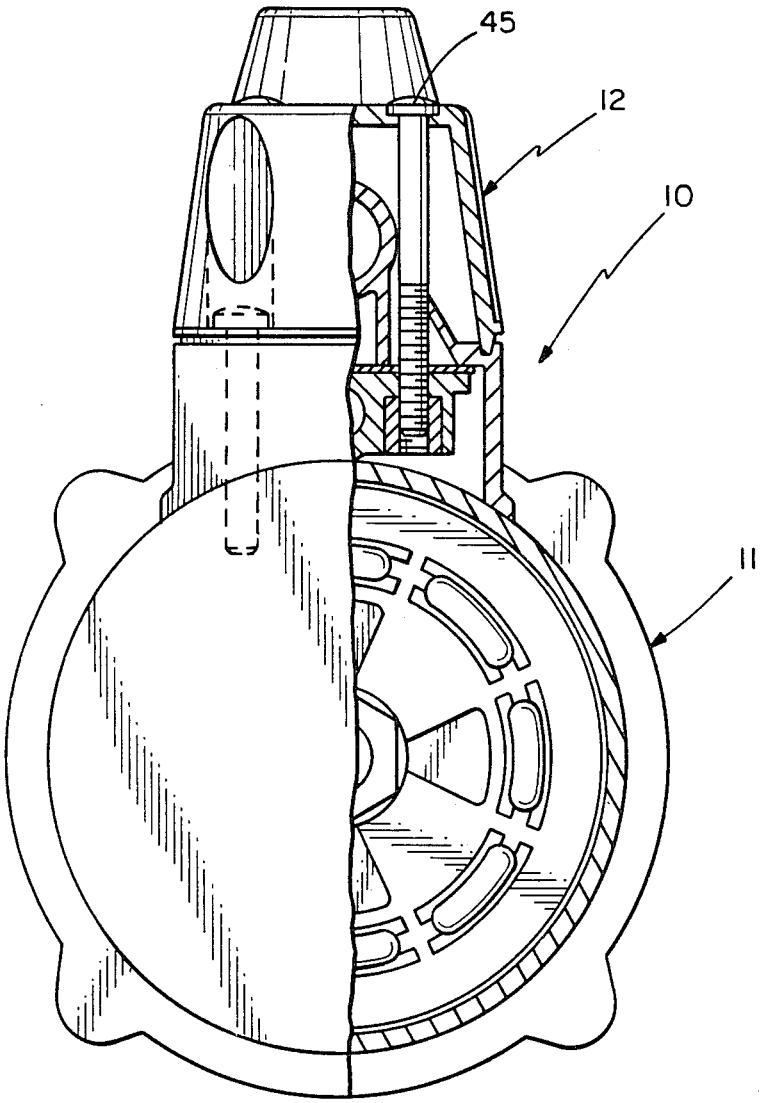
FIG. 3 is a partly fragmentary section taken generally along line 3—3 of FIG. 2.

The cover 41 is clamped against the valve body 36 and the valve body against the manifold 35 with four fasteners 45 illustrated in FIGS. 2 and 3.

The manifold 35 has a large tapered central passage 46 extending from its left end as seen in FIG. 1 with its open end sealed by plug 47 and its right end communicating with passage 49 and ports 50 in valve body 36. The left end of passage 46 communicates with cylinder chamber 30 through bore 52. An identical but reversed tapered passage 53 is formed in the right end of manifold 35 with its open end closed and sealed by plug 55, its left end communicates with valve body passage 56 and ports 57, and its right end communicates with chamber 31 through bore 59.

The manifold 35 has upwardly extending projections 61 and 62 and the cover 41 has similar axially aligned downwardly extending projections 64 and 65 that fit within complementary recesses in the valve body 36 and grooves in bushings 68 and 69 to axially locate the bushings within the valve body 36.

The valve body 36 has a pair of integral cylinders 71 and 72 formed at the opposite ends thereof with bores 73 and 74 therein that slidably receive actuator pistons 76 and 77 which operate the pilot valves 38 and 39 respectively. Cylinders 71 and 72 are closed by stepped annular bosses 79 and 80 held in position by end walls 81 and 82 in the cover 41.

Piston 76 defines chambers 84 and 85 in cylinder 73, while piston 77 defines chambers 86 and 87 in cylinder bore 74.

Figure 4:
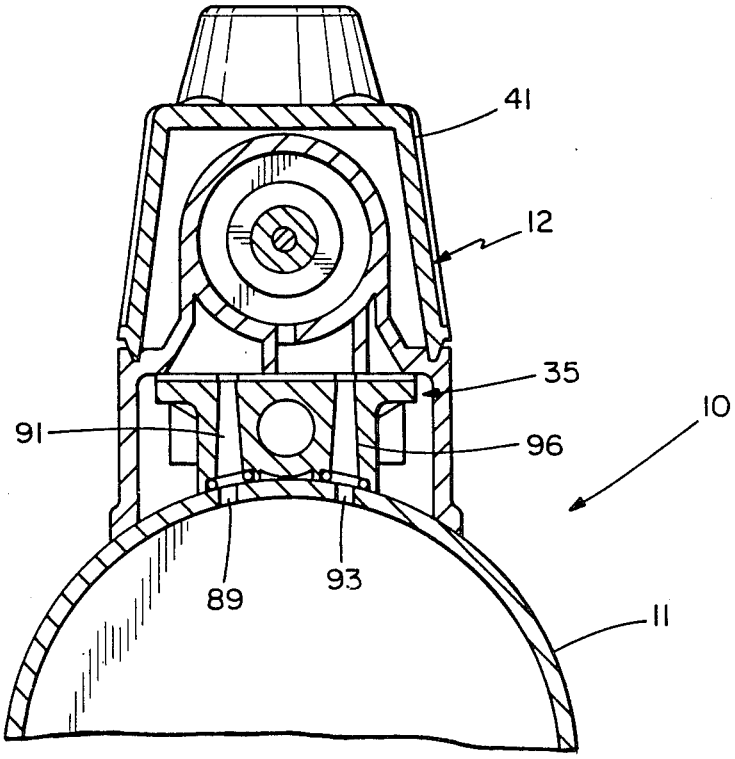
FIG. 4 is a fragmentary section taken generally along line 4—4 of FIG. 2 illustrating the valve assembly control ports.

Chamber 84 communicates with a pilot port 89 in the left end of cylinder 11 through passage 90 in valve body 36, a cross-passage in the bottom of the valve body 36, (see FIG. 9), and passage 91 extending through manifold 35 offset from the main passage 46 as seen more clearly in FIG. 4.

Similarly chamber 86 associated with piston-actuator 77 communicates with a pilot port 93 in the right end of the cylinder 11 through passage 94 in valve body 36, a crosspassage 95 (see FIG. 9) in the bottom of the valve body 36, and offset passage 96 extending through the manifold 35. Port 89 and passage 91 are on the opposite side of the motor center-line from port 93 and passage 96, therefore, are only shown in FIG. 1 for ease of understanding.

The right chamber 85 associated with piston-actuator 76 communicates with main passage 46 through reset passage 98 in valve body 36 and passage 99 in manifold 35, and similarly the left chamber 87 associated with piston 77 communicates with main passage 53 in manifold 35 through reset passage 100 in valve body 36 and passage 101.

The spool or directional control valve 37 is generally annular in configuration and slidably mounted in valve bore 103 in the valve body 36 and is seen to include a plurality sealing lands 104, 105, 106, and 107, a central through-bore 18, and central cross passage 109 that communicates the interior of the valve 36 continuously with inlet pressure from inlet fitting 111. Valve 37 defines pressure chambers 113 and 114 in bore 103 that when pressurized effect shifting of the valve 37.

The pilot valves 38 and 39 are identical and include an enlarged stem portion 116, a sealing land 117 slidable in both the valve bore 108 and an equal diameter bore in bushing 68, and reduced stem portion 119 slidable in a complementary reduced diameter bore in bushing 68. Pilot valve 39 is mounted in bushing 69. Pilot valve sealing lands 117 when positioned in their associated bushings 68, 69 isolate chambers 113, 114 from exhaust passages 121, 124 connected to an exhaust chamber 122 surrounding the valve body, and when positioned outside their associated bushings 68, 69 connect chambers 113, 114 to exhaust through passages 121, 124.

With valve 37 initially in its left position and with the pilot valves 38 and 39 in their outward or normal positions shown, control valve 37 ports fluid from inlet 111 to the left side of piston 25 through main passage 46 driving the piston to the right.

Simultaneously the right side of piston 25 is exhausted through main passage 53, port 57, between lands 106 and 107, and into exhaust passage 122.

Since spool valve passage 109 continuously communicates with inlet fluid pressure at inlet 111 and interior of valve 37 is continuously pressurized biasing pilot valves 38 and 39 outwardly against the actuators 76 and 77. As the piston-actuators 76 and 77 are in effect differential area pistons, i.e. chambers 84 and 86 are smaller than chambers 85 and 87 in terms of their effective area on the pistons, when the opposite sides of the piston 76 and 77 are simultaneously pressurized the pistons will move to their outer-positions. Thus, when chamber 85 is pressurized through reset passage 98 at the same time chamber 84 is pressurized through pilot passage 90, the piston 76 will be biased to the outer-most position. Furthermore, because the pilot valve seal-land 117 is larger than the pilot stem 119, both of the pilot valves 38 and 39 are continuously biased toward their outward or normal positions by inlet pressure within valve 37.

As piston 25 continues to move to the right under high pressure supplied by valve 37 when in its left position, piston 25 will uncover pilot port 93 causing high pressure in cylinder chamber 30 to be applied to the chamber 86 against piston 77 causing it to move to its left most position shifting pilot valve 39 to the left against pilot valve 38, and connecting chamber 114 to exhaust passage 124. Because valve chamber 113 remains pressurized this causes spool or control valve 37 to move from its left-most position to its right most position.

This shifting of main valve 37 to the right connects the formerly pressurized main passage 46 to exhaust 122 across valve 37 between main spool valve lands 104 and 105, and connects inlet 111 to main passage 53 across valve lands 105 and 106 pressurizing cylinder chamber 31 to reverse piston 25 and begin its movement toward the left in its return stroke.

At the same time reset passage 100 is pressurized with connected chamber 87, driving piston-actuator 77 toward its outer-most normal position and at the same time pilot valve 39 follows to its outer position because of the differential pressure acting on it.

Piston 25 then continues to the left with valve member 37 in its right-most position past the position until it uncovers port 89 to high pressure fluid in chamber 31 at which time pilot passage 91 pressurizes chamber 84 shifting piston-actuator 76 to the right, venting chamber 113 to exhaust passage 121 causing shifting of the valve 37 back to its left-most position, simultaneously pressurizing passage 46 across lands 105 and 106 and exhausting passage 53 between lands 106 and 107 reversing the movement of piston 25 toward the right to its initial position and at the same time piston-actuator 76 is reset to its outer-position through reset passage 98 and chamber 85.

As seen in FIGS. 5 to 9, the valve body 36 has opposed generally vertical side walls 124 and 125 with arcuate lower flanges 128 and 129 having lower surfaces 130 and 131 engaging and complementary to cylindrical outer surface 123 of cylinder 14.

Wall flange 128 has four elongated slots 132, 133, 134 and 135 in its lower surface adjacent to cylinder wall 123 and wall flange 129 has similar slots 137, 138, 139 and 140 in its lower surface. Slots 132 to 135 and 137 to 140 define the final exhaust ports for exhaust flow exiting the valve assembly 12, and the axes of all these slots are tangential with respect to the cylinder wall 123.

Figure 5:
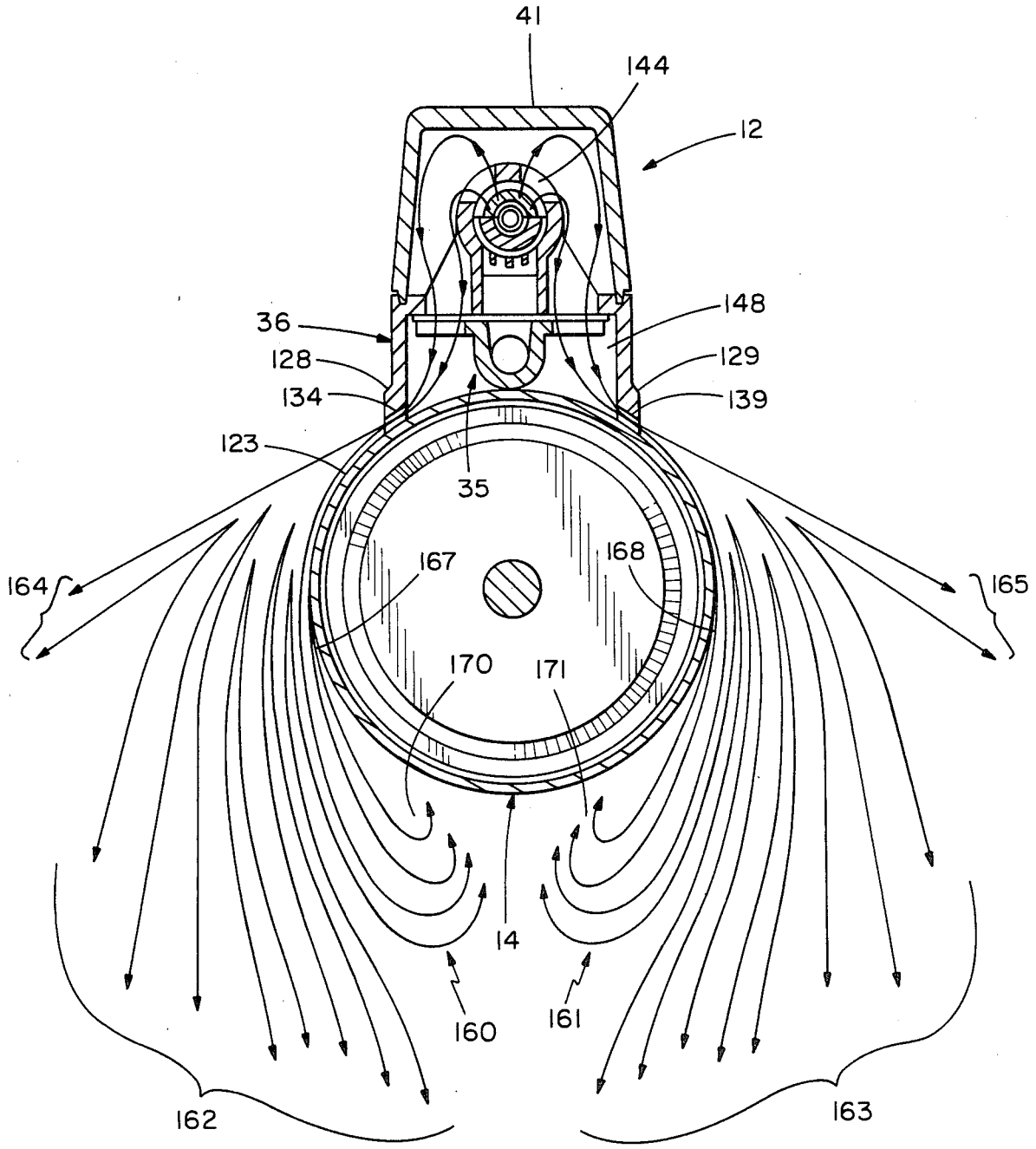
FIGS. 5 and 6 are a cross section and a fragmentary section taken generally along line 6—6 in FIG. 1.
Figure 6:
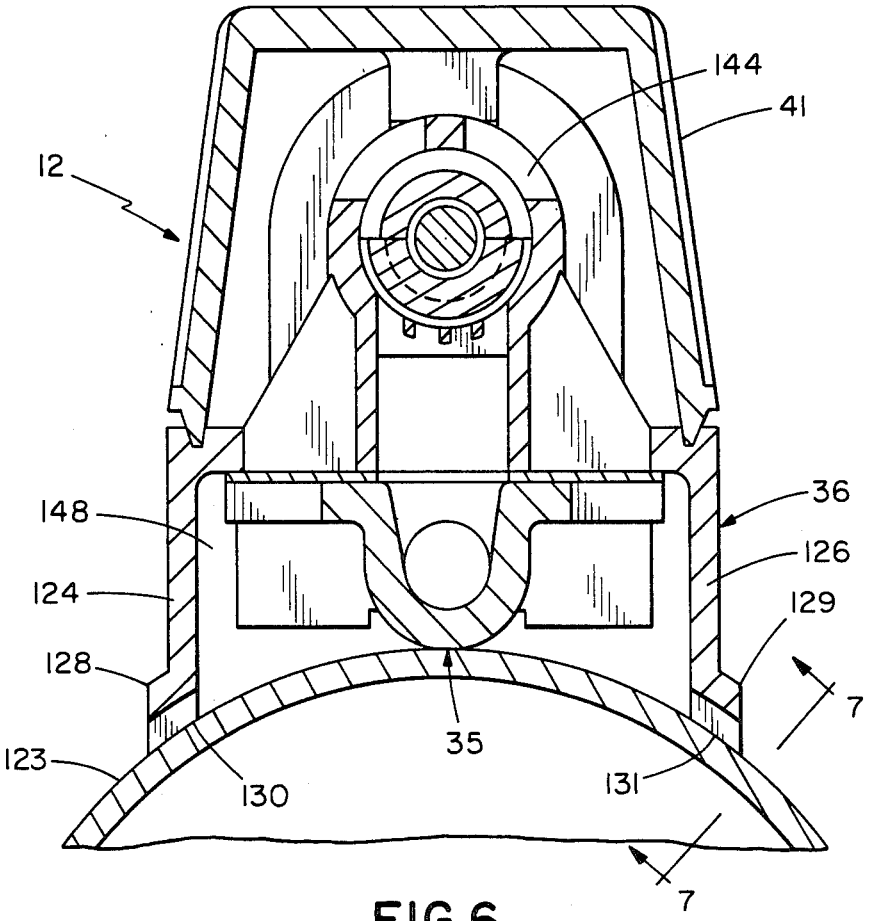
Figure 7:
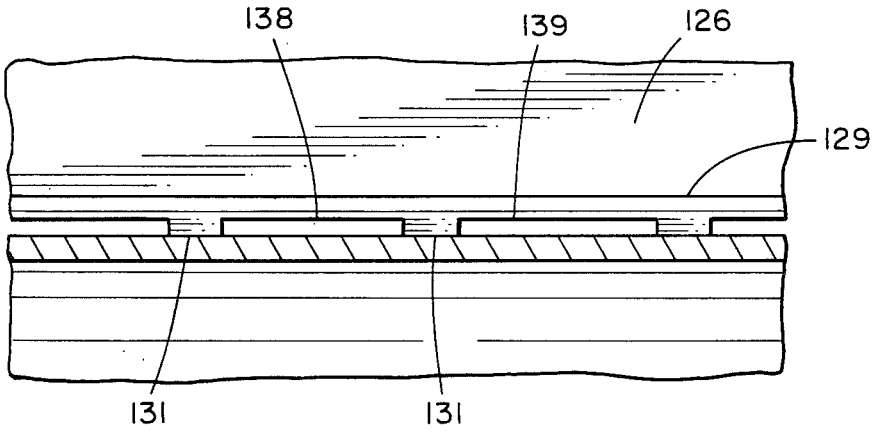
FIG. 7 is a fragmentary view illustrating the final exhaust ports taken generally along line 7—7 of FIG. 6.
Figure 8:
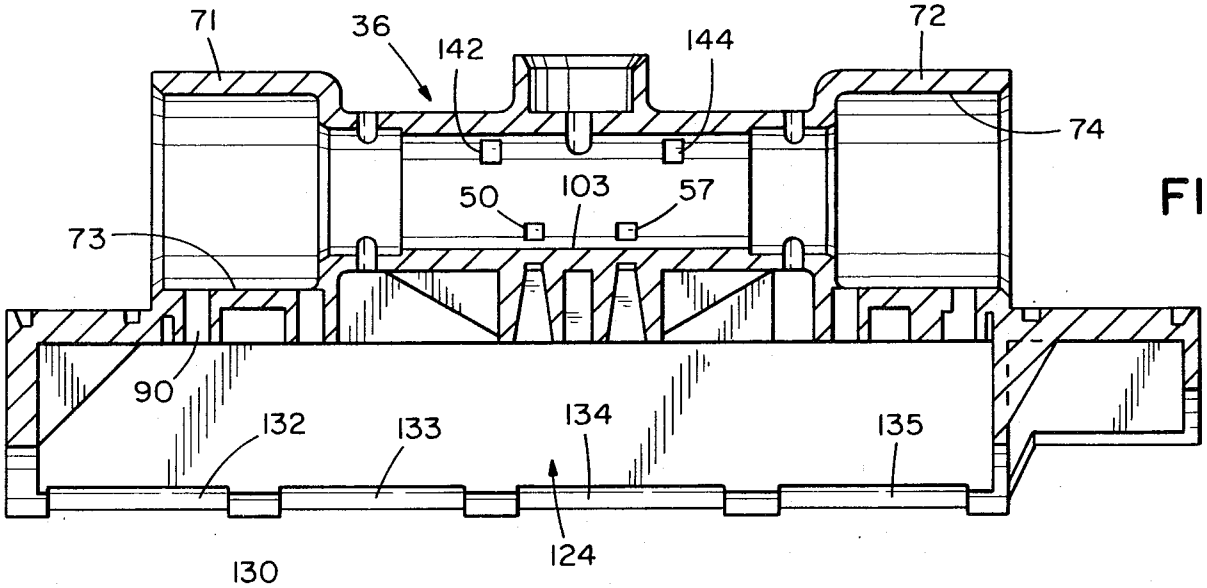
FIG. 8 is a longitudinal section through the valve body sub-assembly.

As seen in FIGS. 5, 6 and 8, the valve body 36 has a first pair of left side co-planar exhaust ports 142 and a similar pair of right side exhaust ports 144. Exaust flow exits main cylinder chamber 31 through ports 144 when main valve 37 is in its left position illustrated in FIG. 1, and exits main chamber 30 through ports 142 when valve 37 is in its right position.

Figure 9:
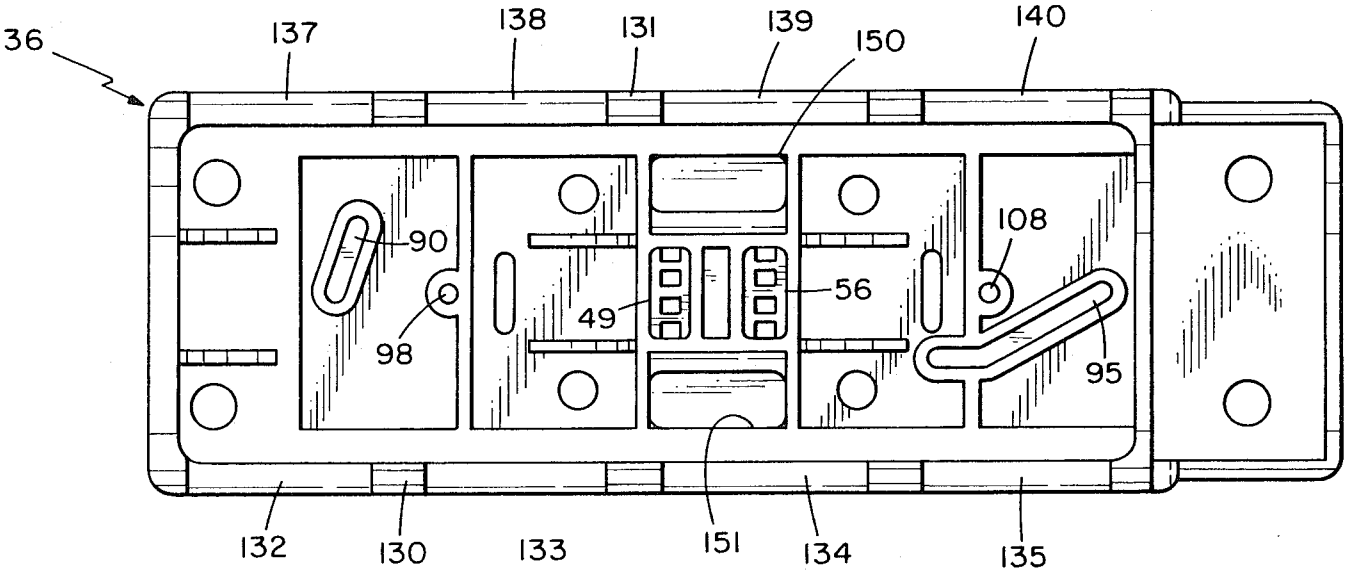
FIG. 9 is a bottom view of the valve body illustrated in FIG. 8.

Air exiting the exhaust ports 142 and 144 expands in the interior of cover 41, which defines an expansion chamber, and passes to the lower interior of the valve body 148 through rectangular passages 150 and 151 illustrated in FIG. 9, and from there the partially expanded fluid passes out of the valve body through ports 132 to 135 on the right side of the valve body as viewed in FIGS. 5 and 6, and ports 137 to 140 on the left side of the body. Fluid exiting ports 132 to 135 flows in a generally fanned or spread fashion in a plane perpendicular to cylinder 14 in a counter clockwise direction while fluid exiting ports 137 to 140 flows generally clockwise around cylinder 14 in the same spread.

As seen in FIG. 5, a substantial portion of exhaust flow exiting both sets of ports attaches by the wall attachment principle to the outer surface 123 identified by arrows 160 and 161 in FIG. 5 and a second substantial portion of the flow exiting the exhaust ports has a progressively decreasing wall attachment effect and spreads out away from the cylinder indicated by arrows 162 and 163 in FIG. 5, and a third portion of the exhaust flow designated by reference numerals 164 and 165 exits substantially tangentially and linearly from the exhaust ports. This spreading and fanning of the exhaust flow from ports 132 to 135 and 137 to 140 diffuses the exhaust and substantially attenuates the noise level of exhaust flow from the valve assembly 12.

Since the wall attachment effect decreases not only with curvature but with arc length, points of separation 167 and 168 occur where attached flow separates from cylinder surface 123 and produces major eddys 170 and 171 adjacent the lower side of the cylinder that further diffuse exhaust flow and reduce exhaust noise level.

I claim:

1. A pneumatic reciprocating piston motor, comprising: a cylinder, a piston reciprocably mounted in the cylinder, a valve assembly for porting fluid under pressure to at least one side of the piston to cause reciprocation of the piston in the cylinder, said valve assembly including a valve member for alternately connecting at least one side of the piston to a source of fluid under pressure and an exhaust, and means for attenuating the noise of fluid exiting the exhaust including an uncovered curved surface outside the valve assembly, and means for directing fluid exiting the exhaust generally tangentially across the curved surface, said curved surface being positioned with respect to the tangential fluid directing means such that at least a portion of the fluid attaches itself to the curved surface.

2. A pneumatic reciprocating piston motor, comprising: a cylinder, a piston reciprocably mounted in the cylinder, a valve assembly for porting fluid under pressure to at least one side of the piston to cause reciprocation of the piston in the cylinder, said valve assembly including a valve member for alternating connecting at least one side of the piston to a source of fluid under pressure and an exhaust, and means for attenuating the noise of fluid exiting the exhaust including an uncovered curved surface outside the valve assembly, and means for directing fluid exiting the exhaust generally tangentially across the curved surface so that a portion of the exhausting fluid attaches to the curved surface and a portion exhausts in a generally straight line direction thereby spreading exhaust flow and attenuating exhaust noise without any separate muffler assembly.

3. A pneumatic reciprocating piston motor, as defined in claim 2, wherein the valve assembly includes a valve body that forms an expansion chamber that receives fluid exiting from the exhaust and decreases the pressure head thereof.

4. A pneumatic reciprocating piston motor, as defined in claim 2, wherein the outer surface of the cylinder defines the curved surface outside the valve assembly against which exhaust flow is directed, said means for directing fluid exiting the exhaust generally tangentially across the curved surface including a plurality of ports in the valve assembly directly adjacent the outer surface of the cylinder and generally tangential with respect thereto.

5. A pneumatic reciprocating piston motor, as defined in claim 4, wherein there are two sets of ports in the valve assembly, one set positioned to direct exhaust flow clockwise around the cylinder and the other positioned to direct exhaust flow counter-clockwise around the cylinder.

6. A reciprocating piston pneumatic motor with an improved exhaust air noise attenuating system, comprising: a cylinder having a cylindrical outer surface and a piston reciprocably mounted therein, a valve assembly mounted on the cylinder including an inlet port connected to a source of fluid under pressure, a passage connected to each end of the cylinder, an exhaust port, and a valve for alternately connecting the cylinder passages to the inlet port and the exhaust port, and a sound attenuation system for air exhausting from the exhaust port including a valve cover in valve assembly that receives and expands air exiting the exhaust port, and a plurality of final exhaust ports in the valve assembly positioned adjacent and tangential to the outer surface of the cylinder so that they direct exhaust flow across the cylinder in a circumferential direction, said cylinder having a sufficient curvature so that a substantial portion of exhaust flow attaches to the outer surface and flows a substantial distance around the surface to a point of separation thereby diffusing air exiting the final ports and attenuating exhaust air noise.

7. A pneumatic reciprocating piston motor, as defined in claim 6, wherein there are two sets of final ports, one on each side of the valve assembly for directing exhaust air in opposite circumferential directions around the cylinder outer surface.

8. A pneumatic reciprocating piston motor, as defined in claim 7, wherein the curvature of the cylinder outer surface positions the point of separation of air flowing across the cylinder from each set of final ports less than 180 degrees from each of the final port sets whereby exhaust flow eddys are produced downstream from the points of separation.

9. A reciprocating piston pneumatic motor with an improved exhaust air noise attenuating system, comprising: a cylinder having a cylindrical outer surface and a piston reciprocably mounted therein, a valve assembly mounted on the cylinder including an inlet port connected to a source of fluid under pressure, a passage connected to each end of the cylinder, an exhaust port, and a valve for alternately connecting the cylinder passages to the inlet port and the exhaust port, and a sound attenuation system for air exhausting from the exhaust port including a valve cover in valve assembly that receives and expands air exiting the exhaust port, and a plurality of final exhaust ports in the valve assembly positioned adjacent and tangential to the outer surface of the cylinder so that they direct exhaust flow across the cylinder in a circumferential direction, said final ports including two sets of final ports, one on each side of the valve assembly for directing exhaust air in opposite circumferential directions around the cylinder outer surface, said cylinder having a sufficient curvature so that a substantial portion of exhaust flow attaches to the outer surface and flows a substantial distance around the surface to a point of separation thereby diffusing air exiting the final ports and attenuating exhaust air noise, the curvature of the cylinder outer surface being sufficient to position the point of separation of air flowing across the cylinder from each set of final ports less than 180 degrees from each of the final port sets whereby exhaust flow eddys are produced downstream from the points of separation.

* * * * *